United States Patent [19]

Müller et al.

[11] Patent Number: 4,515,483

[45] Date of Patent: May 7, 1985

[54] APPARATUS FOR REMOVING SUBSTANCES FROM THE INNER WALLS OF VESSELS

[75] Inventors: Rudolf Müller; Hans-Jürgen Radeklau; Harald Döfke; Detlef Krieger, all of Berlin, Fed. Rep. of Germany

[73] Assignee: Schering Aktiengesellschaft, Berlin and Bergkamen, Fed. Rep. of Germany

[21] Appl. No.: 523,557

[22] Filed: Aug. 16, 1983

[30] Foreign Application Priority Data

Aug. 16, 1982 [DE] Fed. Rep. of Germany ..... 3230763

[51] Int. Cl.[3] ..... B01F 7/24

[52] U.S. Cl. ..... 366/303; 366/311; 366/312; 366/313; 366/319

[58] Field of Search ..... 34/166; 366/195, 196, 366/302, 303, 307, 311, 312, 313, 318, 319, 323, 325

[56] References Cited

U.S. PATENT DOCUMENTS

| | | | |
|---|---|---|---|
| 1,366,777 | 1/1921 | Flowers | 366/311 |
| 3,292,911 | 12/1966 | Paul | 366/313 |
| 4,095,307 | 6/1978 | Brubaker | 366/311 |
| 4,245,399 | 1/1981 | Müller | 34/166 |
| 4,274,751 | 6/1981 | Rector | 366/313 |

*Primary Examiner*—Robert W. Jenkins
*Assistant Examiner*—Arthur D. Dahlberg
*Attorney, Agent, or Firm*—Millen & White

[57] ABSTRACT

A device for the removal of substances on the inner walls of agitated reaction vessels includes scrapers. The scrapers are adjustable angularly or displaceable toward and away from the walls of the vessel and supported from an agitator shaft to scrape off material accumulating on the walls of the reaction vessel.

9 Claims, 6 Drawing Figures

FIG. 2a
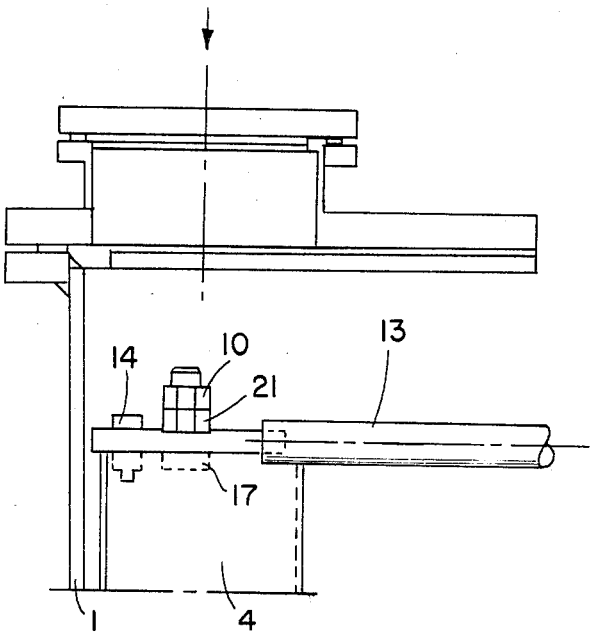
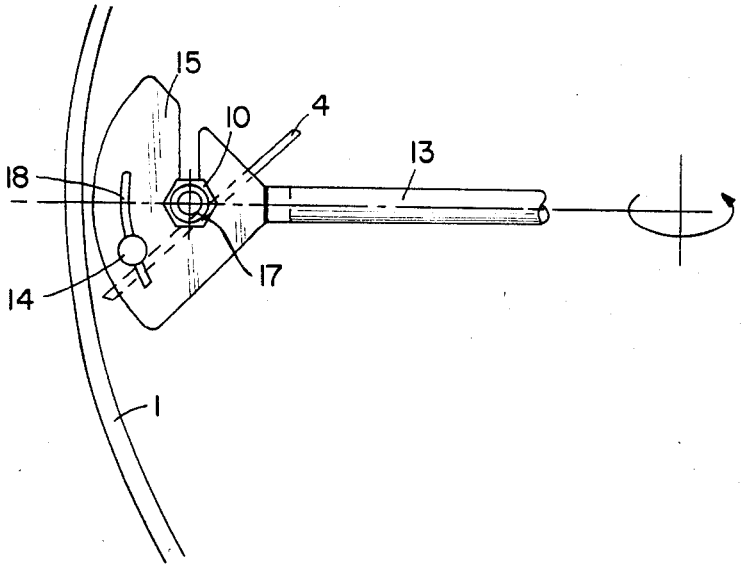
FIG. 2b

APPARATUS FOR REMOVING SUBSTANCES FROM THE INNER WALLS OF VESSELS

BACKGROUND OF THE INVENTION

This invention relates to an apparatus for removing substances which become attached to the inner walls of a vessel, e.g., a dryer. The removal of such substances is achieved by means of scrapers.

The prior art teaches a number of different dryer structures which are utilized in industry for the drying of various materials. The construction of these dryers depends on the particular type of material to be dried therein. The drying of smeary materials, i.e., nonpourable materials, presents unusual problems.

One prior art arrangement disclosed in U.S. Pat. No. 4,245,399 provides a dryer having resilient scrapers arranged on an agitator shaft to function both as scrapers and agitating aids. The agitator shaft scrapers are arranged (1) as a spiral-shaped screw, and (2) as a vertically extending blade.

The conventional prior art devices however, have the disadvantage that a desired spacing, with respect to the wall, of less than 5 mm is very difficult to achieve, especially in the case when the dryer is a very large vessel. As a consequence, a layer of material eventually builds up on the walls due to the inability to scrape it off, and inhibits the heat transfer required for drying the rest of the material in the dryer. In the case of larger layer thicknesses this also leads to a large thermal load on the materials lying on the heated wall.

SUMMARY OF THE INVENTION

It is thus an object of the present invention to provide a device which overcomes the above-enumerated disadvantages of the prior art.

It is another object of the present invention to provide such a device or apparatus for removing substances from the inner walls of a vessel.

Still another object is to provide such a device having displaceable and/or angularly adjustable scrapers for removing such substances, which scrapers are adapted for being positioned in close proximity to the walls of such a vessel effective to scrape-off materials accumulating thereon.

Upon further study of the specification and appended claims, further objects and advantages of this invention will become apparent to those skilled in the art.

In one aspect the invention comprises a device for removing substances from the inner walls of vessels of the type having a vertical agitator shaft. The device is characterized by the attachment of displaceable scrapers to the agitator shaft by means of the arms of the agitator. By displaceable is meant movable, in any manner, to be placed in proximity with or away from, in this case, the walls of the vessel. This includes both linear as well as angular displacement.

In another aspect, the invention is an apparatus for removing substances from the inner walls of a vessel. The apparatus comprises vertically extending agitating shaft means arranged in a vessel, and having agitator arms for agitating materials in the vessel. In addition there are displaceable scraper means displaceably attached to the agitator shaft means at the agitator arms, and adapted for being displaced to be in sufficient proximity to the walls of the vessel effective to scrape off material accumulated on the walls upon operation of the vertically extending agitating shaft means.

For this purpose, the adjustable scraper means are attached to the agitator shaft means by a connection to the agitator arms. In one specific embodiment the scrapers are attached to a spiral-shaped screw or helix which is optionally provided to enhance conveying of material in the vessel. In another specific embodiment the edges of the scrapers facing the inner wall of the vessel are coated with a synthetic resin, such as "Teflon", or with a relatively soft metal, such as bronze, in a manner fully conventional in the art.

In still another specific embodiment, a pin is arranged at the lower end of the spiral-shaped screw or helix near an outlet of the vessel in which the invention is arranged to break up any material building up to avoid blockage occurring at the outlet.

The scrapers are optionally divided into multiple sections or parts, and the parts are interconnected by means of combs, bridging a dividing space between the scraper sections or parts. In this case, a projection such as a web 8 is attached to and extends from the vessel walls, and the comb arrangement permits the scrapers to operate in a manner to pass such webs through the space separating the scraper sections or parts which are bridged by the comb. The scrapers can be mounted (1) rotatable with respect to the angle of inclination to the vessel wall or (2) displaceable toward the vessel wall to be in close proximity therewith.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein:

FIG. I is a partial schematic view of one embodiment of the invention arranged in a vessel;

Figure 1:
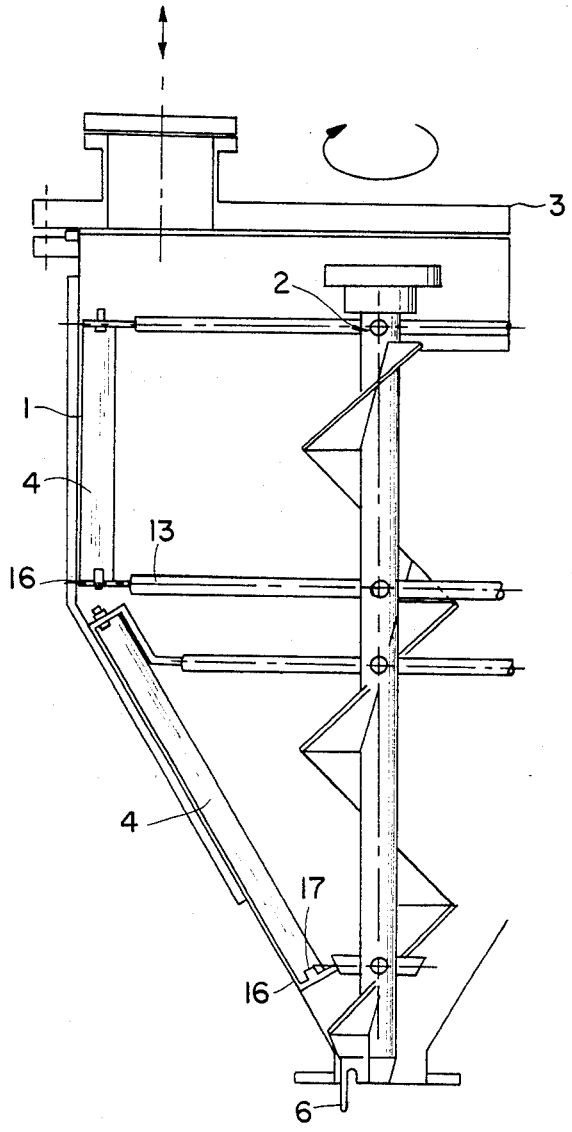
Figure 3:
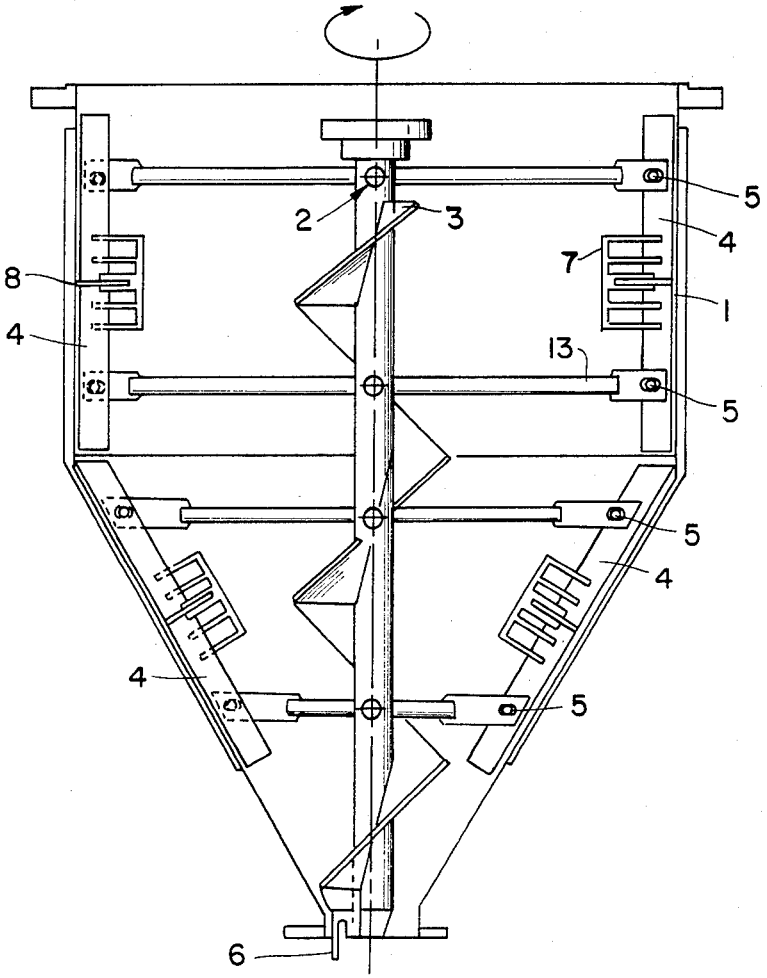
Figure 4:
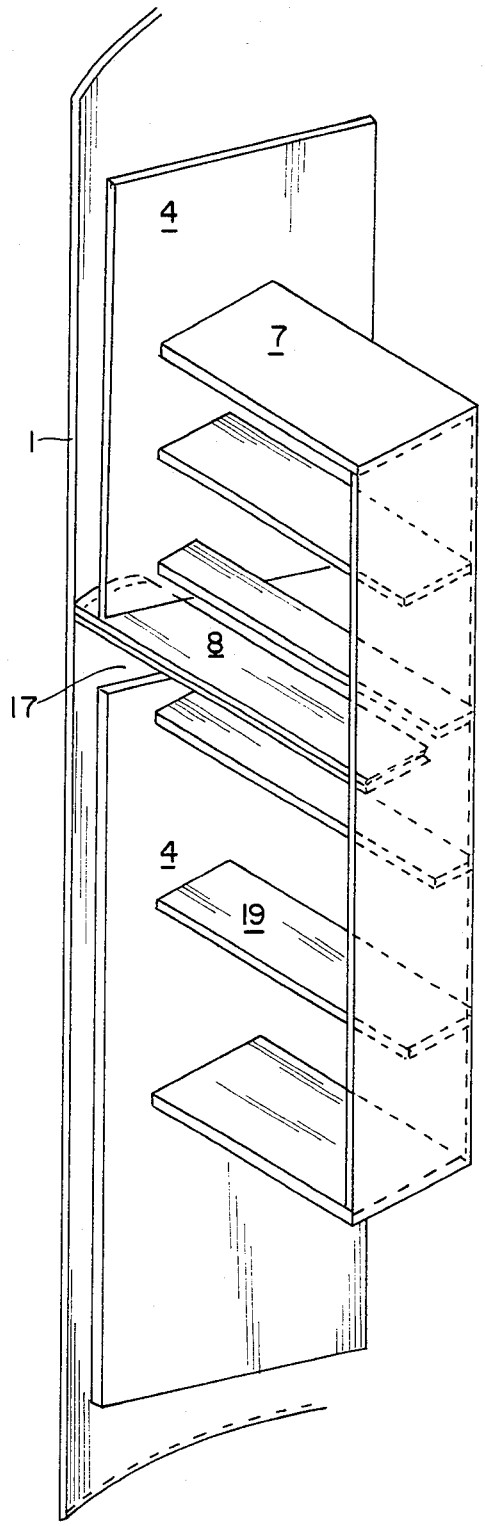
Figure 5:
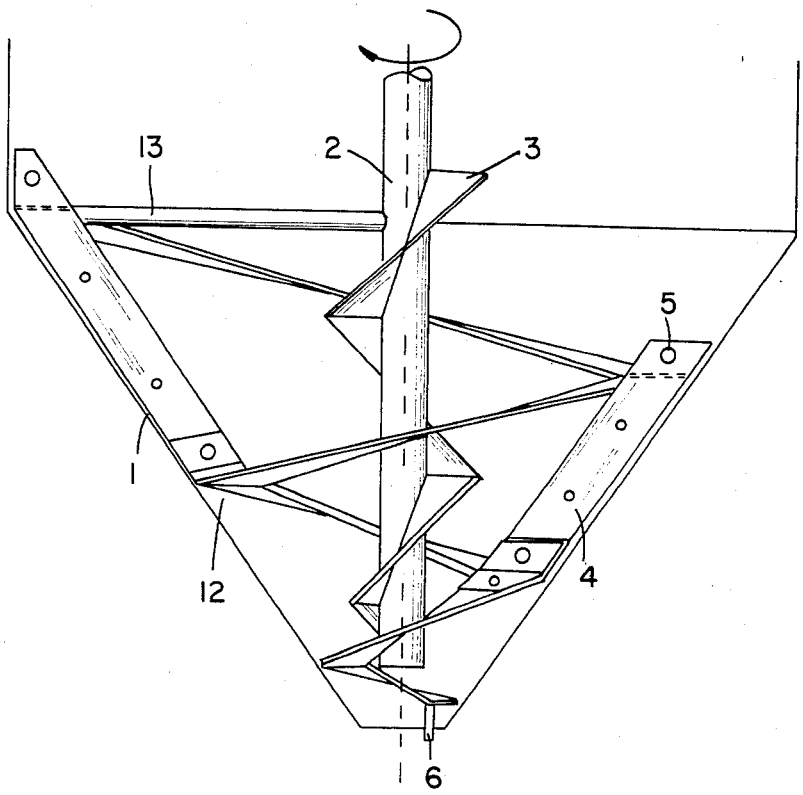

FIGS. II*a* and II*b* are, respectively, a partial side schematic view and a partial top schematic view of the mounting arrangement for the scrapers in accordance with one embodiment;

FIG. III is a schematic view of another embodiment, similar to FIG. 1, showing the scrapers displaceably mounted;

FIG. IV is an enlarged view of the comb mounting arrangement for the scrapers; and FIG. V is a partial view of a screw or helix for transporting material to be dried, arranged in the device of the invention.

DETAILED DISCUSSION OF THE INVENTION

FIG. I schematically shows the arrangement of one embodiment of the device of the invention. An agitator shaft 2 having a mixing screw type conveyor 3 is arranged in a dryer. Typically flow through the dryer is from an inlet at the top to an outlet at the bottom.

Scrapers 4 are secured to the shaft 2 by agitator arms 13 and are adapted to move along the vessel wall 1 upon rotational movement of the agitator shaft 2. The means for rotating the shaft are conventional, such as a variable speed electric motor (not shown). Other such means adaptable for such use, in a conventional manner, will be readily apparent to those of ordinary skill in the art.

As shown in FIGS. II*a* and II*b*, , in one embodiment the scrapers are attached to the agitator arms 13 by means of an upper mounting plate 15 and a lower mounting plate 16. The scraper 4 is held thereon by a screw 10 and bolt 17 and is rotatable within the limits defined by slot 18 by rotation about the axis of the bolt 17 and the mounting screw 10 which includes a counter-nut 21. The angle of the scrapers 4 can be fixed in position by means of a locking screw 14 arranged in the slot 18 in a conventional manner.

The range of angle between the agitator arm 13 and the scraper 4 is about 15° above the arm 13 and 30° below the arm 13 (see FIG. II*b*).

FIG. III shows a scraper 4 attached to the agitator arm 13 at slot-like holes 5 which provide displaceability from and toward the vessel wall 1 with respect to the axis, i.e., central axis, of rotation of shaft 2 as shown thereon. In this embodiment, the scrapers 4 are shown divided, in a conical as well as in a cylindrical portion of the dryer and arranged into separate sections or parts. Each section of the scraper 4 is attached to a separate and distinct agitator arm 13. More particularly, each scraper 4 in each portion of the dryer is typically divided into two halves with the two halves being interconnected by means of a comb 7 as illustrated.

The combs 7 are arranged on the front face, in the direction of rotation, of the scrapers 4. As shown in FIG. IV a spacing 17 is provided between respective two of the scrapers 4 which are interconnected by the comb 7. The teeth 19 of the comb are also arranged to maintain the region adjacent the spacing 17 clear of obstructions. In this embodiment, a web or projection 8 is disposed or extends from the wall 1 of the dryer through the spacing 17 provided between the scrapers 4, as the scrapers 4 pass the webs or projections 8 upon movement thereof. The number of webs or projections 8, which are arranged at the same level on the inner wall 1, is selected to provide the function of breaking up clumping material by interacting with the scrapers 4. Preferably, 4–8 of these webs or projections 8 are located at each level along the wall 1. In addition, the number of teeth 19 of the comb 7 is selected in the same manner, preferably this number is an integer larger than 2, more preferably 4 to 8 teeth per comb 7. The comb 7 thus also functions to continuously break up any clumps of product which may form.

The material employed in constructing the scrapers 4 is sheet material, like synthetic resin sheet material, resin-coated steel sheets or more preferably stainless steel.

In another embodiment shown in FIG. V the dryer comprises, in addition to the mixing and conveyor worm or screw 3, a spiral-shaped screw or helix 12 for transporting the material to be dried throughout the dryer. In this case, the scraper 4 is attached to the spiral-shaped screw 12 at an angle, through slotted holes 5 which ensures that the scraper 4 can be adjusted with respect to its spacing from the vessel wall 1.

The scrapers 4 are placed in a near proximity to the inner wall 1 in a manner that the edge of the scraper does not touch the surface of the wall 1. The mean distance between the edge of the scraper 4 and the inner wall 1 is determined by the concentricity tolerance of the vessel.

At the lower end of the mixing or conveyor worm 3, there can also be provided a vertically downwardly extending pin 6 which is mounted for breaking up any accumulation of product building up in the outlet of the dryer. The pin 6 operates at a spacing of only a few millimeters i.e., 2–5 mm above a shutoff valve of the vessel outlet. The pin 6 can be integral with the conveyor worm 3 or, in any conventional way, like screwed or welded, fixed at the lower end of the conveyor worm 13.

The scrapers 4 are aligned so that upon operation of the agitating shaft 2, any substances to be dried accumulating on the walls 1 are scraped off the walls 1 and forced into the interior of the dryer. Thus, the invention provides the advantage that a buildup of layers of substances being dried on the inner wall 1 of the dryer is avoided, thereby eliminating inhibition of heat transfer, so that the substances being dried are not exposed to a high thermal load over a long period of time and the thermal load is more evenly distributed. The device furthermore provides the advantages that any lumps formed in the interior of the dryer are recomminuted, and any bridges or agglomerations of substances which may form at the outlet are immediately broken up again, thus ensuring an uninterrupted flow of material through the dryer.

From the foregoing description, one skilled in the art can easily ascertain the essential characteristics of this invention, and without departing from the spirit ans scope thereof, can make various changes and modifications of the invention to adapt it to various usages and conditions.

What is claimed is:

1. An apparatus for removing substances from the inner walls of a vessel, comprising:

vertically extending agitating shaft means arranged in a vessel, and having agitator arms for agitating materials in said vessel;

displaceable scraper means displaceably attached to said agitator shaft means at said agitator arms, and adapted for being positioned in sufficient proximity to the walls of said vessel effective to scrape off material accumulated on the walls upon operation of said vertically extending agitating shaft means, and said scraper means comprising plural parts, which are interconnected by a comb, in a manner providing a spacing between the scraper means parts; and webs attached to the vessel walls so as to extend into said spacing between the scraper means parts when the scraper is put into operation.

2. An apparatus according to claim 1, wherein said scraper means (4) are attached to a spiral-shaped screw (12), with said screw (12) arranged in the lower portion of the vessel to remove substances from said vessel.

3. An apparatus according to claim 2, wherein the edges of the scraper means (4) facing the inner walls of said vessel walls are coated with a synthetic resin.

4. An apparatus according to claim 2, wherein the edges of the scraper means (4) facing the inner walls of said vessel are coated with a soft metal.

5. An apparatus according to claim 1, wherein the edges of the scraper means (4) facing the inner walls of said vessel walls are coated with a synthetic resin.

6. An apparatus according to claim 5, wherein said coating is Teflon.

7. An apparatus according to claim 1, wherein the edges of the scraper means (4) facing the inner walls of said vessel are coated with a soft metal.

8. An apparatus according to claim 7, wherein said metal is bronze.

9. An apparatus according to claim 1, further comprising a pin (6) connected at the lower end of a spiral-shaped screw (12) disposed around said shaft means, and proximate the outlet of said vessel for breaking up clumping material in said vessel upon operation of said shaft means.

* * * * *